US009206516B2

(12) United States Patent
Powell et al.

(10) Patent No.: US 9,206,516 B2
(45) Date of Patent: Dec. 8, 2015

(54) LIQUID ANODES AND FUELS FOR PRODUCTION OF METALS FROM THEIR OXIDES BY MOLTEN SALT ELECTROLYSIS WITH A SOLID ELECTROLYTE

(75) Inventors: Adam Clayton Powell, Newton, MA (US); Soobhankar Pati, Boston, MA (US); Uday B. Pal, Dover, MA (US); Steven J. Derezinski, III, Wellesley, MA (US); Steve R. Tucker, Medford, MA (US)

(73) Assignee: Infinium, Inc., Natick, MA (US)

( * ) Notice: Subject to any disclaimer, the term of this patent is extended or adjusted under 35 U.S.C. 154(b) by 289 days.

(21) Appl. No.: 13/592,211

(22) Filed: Aug. 22, 2012

(65) Prior Publication Data

US 2013/0186769 A1 Jul. 25, 2013

Related U.S. Application Data

(60) Provisional application No. 61/526,129, filed on Aug. 22, 2011.

(51) Int. Cl.

| | |
|---|---|
| ***C25C 3/00*** | (2006.01) |
| ***C25C 7/02*** | (2006.01) |
| ***C25C 1/00*** | (2006.01) |
| ***C25C 7/00*** | (2006.01) |

(52) U.S. Cl.

CPC ... *C25C 1/00* (2013.01); *C25C 3/00* (2013.01); *C25C 7/005* (2013.01); *C25C 7/007* (2013.01); *C25C 7/025* (2013.01)

(58) Field of Classification Search

None

See application file for complete search history.

(56) References Cited

U.S. PATENT DOCUMENTS

| | | | | |
|---|---|---|---|---|
| 400,664 | A | | 4/1889 | Hall |
| 3,262,868 | A | * | 7/1966 | Juda ..... 205/510 |
| 3,578,580 | A | * | 5/1971 | Schmidt-Hatting et al. ..... 204/243.1 |

(Continued)

FOREIGN PATENT DOCUMENTS

| | | | |
|---|---|---|---|
| WO | WO 2006/138611 | A2 * | 12/2006 |
| WO | WO-2007/011669 | | 1/2007 |
| WO | WO-2010/126597 | | 11/2010 |

OTHER PUBLICATIONS

International Search Report and Written Opinion issued for PCT/US12/51933, mailed Nov. 20, 2012, 13 pages.

(Continued)

*Primary Examiner* — Harry D Wilkins, III

(74) *Attorney, Agent, or Firm* — Wilmer Cutler Pickering Hale and Dorr LLP

(57) ABSTRACT

In one aspect, the present invention is directed to liquid anodes and fuels for production of metals from their oxides. In one aspect, the invention relates apparatuses for producing a metal from a metal oxide comprising a cathode in electrical contact with an electrolyte, a liquid metal anode separated from the cathode and the electrolyte by a solid oxygen ion conducting membrane, a fuel inlet, and a power supply for establishing a potential between the cathode and the anode. In another aspect, the invention relates to methods for production of metals from their oxides comprising providing a cathode in electrical contact with a molten electrolyte, providing a liquid metal anode separated from the cathode and the molten electrolyte by a solid oxygen ion conducting membrane, providing a fuel inlet, delivering a gaseous fuel comprising hydrogen to the liquid metal anode via the fuel inlet, and establishing a potential between the cathode and the anode.

68 Claims, 3 Drawing Sheets

(56) References Cited

U.S. PATENT DOCUMENTS

| | | | | | |
|---|---|---|---|---|---|
| 3,718,506 | A | | 2/1973 | Fischer et al. | |
| 3,799,522 | A | * | 3/1974 | Brant et al. | 266/225 |
| 4,042,755 | A | * | 8/1977 | Anbar | 429/415 |
| 4,173,518 | A | | 11/1979 | Yamada et al. | |
| 4,179,103 | A | * | 12/1979 | Bentz et al. | 266/225 |
| 4,327,901 | A | * | 5/1982 | Kaiser | 266/217 |
| 4,397,729 | A | | 8/1983 | Duruz et al. | |
| 5,006,209 | A | | 4/1991 | Beck et al. | |
| 5,246,551 | A | * | 9/1993 | Pletcher et al. | 205/510 |
| 5,254,232 | A | | 10/1993 | Sadoway | |
| 5,465,943 | A | * | 11/1995 | Rinnhofer et al. | 266/220 |
| 5,798,187 | A | | 8/1998 | Wilson et al. | |
| 5,976,345 | A | | 11/1999 | Pal et al. | |
| 6,299,742 | B1 | | 10/2001 | Pal et al. | |
| 7,229,710 | B2 | | 6/2007 | Tao et al. | |
| 7,235,321 | B2 | | 6/2007 | Sarkar et al. | |
| 7,678,484 | B2 | | 3/2010 | Tao et al. | |
| 8,658,007 | B2 | * | 2/2014 | Pal | 204/246 |
| 2004/0194574 | A1 | * | 10/2004 | Cardarelli | 75/10.26 |
| 2006/0127725 | A9 | * | 6/2006 | Sarkar et al. | 429/31 |
| 2009/0000955 | A1 | * | 1/2009 | Pal | 205/371 |
| 2009/0071841 | A1 | * | 3/2009 | Pal et al. | 205/638 |
| 2010/0276297 | A1 | * | 11/2010 | Powell et al. | 205/350 |
| 2011/0079517 | A1 | | 4/2011 | Powell, IV et al. | |

OTHER PUBLICATIONS

Namboothiri et al., "Aluminium production options with a focus on the use of a hydrogen anode: a review", Asia-Pacific J. Chem. Eng., 2007, vol. 2, No. 5, pp. 442-447.

Pal, Uday, et al., "The Use of Solid-Oxide-Membrane Technology for Electrometallurgy", JOM Journal of the Minerals, Metals and Materials Society, May 2007, vol. 59, No. 5, pp. 44-49.

Krishnan, A. et al., "Solid Oxide Membrane Process for Magnesium Production directly from Magnesium Oxide," Metall. Mater. Trans. 36B, pp. 463-473, 2005.

Britten, S.C., et al., "Solid-State Amperometric Sensor for the In-Situ Monitoring of Slag Composition and Transport Properties", Metallurtical and Materials Transactions, Aug. 2000, vol. 31B, pp. 733-753.

Krishnan et al., "Solid Oxide Membrane (SOM) technology for environmentally sound production of tantalum metal and alloys from their oxide sources", Scan. J. Metall., 2005, vol. 34, No. 5, pp. 293-301.

Pal, "Solid Oxygen Ion Conducting Membrane Technology for Direct Reduction of Magnesium from its Oxide at High Temperatures", U.S. Dept. of Energy Automotive Lightweighting Materials 2001 Annual Progress Report, 259 pages.

Pal, Uday B., et al., "Emerging SOM Technology for the Green Synthesis of Metals from Oxides", JOM, Oct. 2001, vol. 53, No. 10, pp. 32-35.

Krishnan, Ajay, "Solid Oxide Membrane Process for Direct Reduction of Magnesium from Magnesium Oxide", Boston University College of Engineering, Ph.D. Thesis, 2006.

Pati, Soobhankar, et al., "Hydrogen Production Using Solid Oxide Membrane Electrolyzer with Solid Carbon Reductant in Liquid Metal Anode", J. Electrochemical Society, 2009, vol. 156, No. 9, pp. B1067-B1077.

Pati, Soobhankar, et al., "A solid oxide membrane electrolyzer for production of hydrogen and syn-gas from steam and hydrocarbon waste in a single step", International Journal of Hydrogen Energy, 2011, vol. 36, pp. 152-159.

Suput, M., et al., "Solid oxide membrane technology for environmentally sound production of titanium", Mineral Processing and Extractive Metallurgy, Jun. 2008, vol. 117, No. 2, pp. 118-122.

* cited by examiner

LIQUID ANODES AND FUELS FOR PRODUCTION OF METALS FROM THEIR OXIDES BY MOLTEN SALT ELECTROLYSIS WITH A SOLID ELECTROLYTE

CROSS-REFERENCE TO RELATED APPLICATIONS

This application claims the benefit of and priority to U.S. provisional patent application Ser. No. 61/526,129, filed Aug. 22, 2011, entitled "Liquid Anodes and Fuels for Production of Metals from Their Oxides by Molten Salt Electrolysis with a Solid Electrolyte", the disclosure of which is hereby incorporated by reference in its entirety for all purposes.

All publications, patent applications, patents, and other references mentioned herein are incorporated by reference in their entirety. The patent and scientific literature referred to herein establishes knowledge that is available to those skilled in the art. The issued patents, applications, and other publications that are cited herein are hereby incorporated by reference to the same extent as if each was specifically and individually indicated to be incorporated by reference. In the case of inconsistencies, the present disclosure will prevail.

FIELD OF THE INVENTION

The invention relates to production of metals from their oxides by molten salt electrolysis.

BACKGROUND OF THE INVENTION

Several processes for extraction of metals from their oxides have used electrolysis on an industrial scale since the invention of the Hall-Héroult cell for aluminum production in 1886 (U.S. Pat. No. 400,664; herein incorporated by reference in its entirety). When the raw material is water-soluble and the product metal is not very reactive, then this can be done at room temperature in an aqueous electrolyte, e.g. electrolysis of copper chloride to make copper metal and chlorine gas. For others like aluminum oxide electrolysis in the Hall-Héroult cell, it is necessary to dissolve the raw material in a molten salt electrolyte such as cryolite, which in turn requires high temperature cell operation.

It is difficult to find an anode material that exhibits good electrical conductivity, whose reaction with oxygen does not cause a problem for cell operation, and which is not expensive. The Hall-Héroult cell uses graphitic carbon, which adds a consumable material as an operating expense, and whose reaction with oxygen and molten cryolite produces carbon dioxide, perfluorocarbons, and other harmful reaction products.

Other materials include, for example, aluminum bronzes, such as aluminum-copper intermetallic compounds and alloys (U.S. Pat. No. 5,254,232; herein incorporated by reference in its entirety); cermets or ceramic-metal composites (U.S. Pat. Nos. 4,397,729; 5,006,209; each herein incorporated by reference in its entirety); electronic oxides, which are oxide materials with good electronic conductivity, such as nickel ferrite and tin oxide (U.S. Pat. No. 4,173,518; herein incorporated by reference in its entirety); and porous graphite with natural gas reductant (Namboothiri et al., *Asia-Pacific J. Chem. Eng.* 2007, 2(5), 442-7; herein incorporated by reference in its entirety). The Namboothiri process uses graphite and gas in direct contact with the molten salt, and does not use a liquid metal anode.

The solid oxide membrane (SOM) electrolysis process has provided an alternative electrochemical method for refinement of metal oxides, and sends a pure oxygen gas stream to the anode (see, for example, U.S. Pat. Nos. 5,976,345 and 6,299,742; each herein incorporated by reference in its entirety). The SOM process comprises a solid oxygen ion-conducting membrane (SOM) typically consisting of zirconia stabilized by yttria (YSZ) or other low valence oxide-stabilized zirconia, for example, magnesia- or calcia-stabilized zirconia (MSZ or CSZ, respectively) in contact with the molten salt electrolyte bath in which the metal oxide is dissolved, an anode in ion-conducting contact with the solid oxygen ion-conducting membrane, and a power supply for establishing a potential between the cathode and anode. The metal cations are reduced to metal at the cathode, and oxygen ions migrate through the membrane to the anode where they are oxidized to produce oxygen gas. The first demonstration of the SOM process produced a few tenths of a gram of iron and silicon in a steelmaking slag, and the process has made progress toward the industrial production of other metals such as magnesium, tantalum and titanium (see, for example, U.S. Pat. No. 6,299,742; Pal and Powell, *JOM* 2007, 59(5):44-49; *Metall. Trans.* 31B:733 (2000); Krishnan et al, *Metall. Mater. Trans.* 36B:463-473 (2005); and Krishnan et al, *Scand. J. Metall.* 34(5): 293-301 (2005); each hereby incorporated by reference herein in its entirety).

The SOM process runs at high temperature, typically 1000-1300° C., in order to maintain high ionic conductivity of the SOM. However, this presents a problem for the anode, which must have good electronic conductivity at this high temperature while exposed to pure oxygen gas at approximately 1 atm pressure.

The best technical approach to date has been to use either an oxygen-stable liquid metal, such as silver or its alloys with dilute copper, tin, etc., or "oxygen stable electronic oxides, oxygen stable cermets, and stabilized zirconia composites with oxygen stable electronic oxides," as the anode (PCT/US06/027255; herein incorporated by reference in its entirety). If the anode is a liquid metal, then the oxygen produced there accumulates dissolved in the metal until its evaporation rate balances the rate of its production. Liquid metal anodes have the advantage of excellent electronic conductivity (around 10,000 S/cm for liquid silver), simplicity and robustness, and gas permeability is relatively good as long as oxygen bubbles can form easily. However, oxygen-stable liquid metal candidates are typically limited to very expensive silver and gold, and their alloys with very small amounts of other metals.

Thus, there remains a need for more efficient and scalable apparatuses and processes to process metal oxides into pure metals. There also remains a need for stable and inexpensive anode systems to process metal oxides into pure metals. In particular, there remains a need for apparatuses and methods that stabilize anodes in an oxygen generating environment. This invention addresses these needs.

BRIEF SUMMARY OF THE INVENTION

In one aspect of the invention, a method for producing metal from a metal oxide is provided.

In one aspect, the invention comprises a method for producing a metal from a metal oxide comprising: a) providing a cathode in electrical contact with a molten electrolyte; b) providing a liquid metal anode separated from the cathode and the molten electrolyte by a solid oxygen ion conducting membrane; c) providing a fuel inlet tube in proximity to the liquid metal anode, the fuel inlet tube comprising a material that maintains its structural integrity in a reducing environment; d) delivering a gaseous fuel comprising hydrogen and optionally carbon to the liquid metal anode via the fuel inlet tube; and e) establishing a potential between the cathode and the liquid metal anode. In some embodiments, the fuel inlet is in electrical contact with the liquid metal anode. In some embodiments, the method further comprises providing a cooling tube extending upwardly from the anode. In some embodiments, combustion products are cooled in the cooling tube. In some embodiments, liquid anode vapor is condensed in the cooling tube.

In another aspect, the invention comprises an apparatus for producing a metal from a metal oxide comprising: a) a cathode in electrical contact with an electrolyte; b) a liquid metal anode separated from the cathode and the electrolyte by a solid oxygen ion conducting membrane; c) a fuel inlet tube in proximity to the liquid metal anode, the fuel inlet tube comprising a material that maintains its structural integrity in a reducing environment; and d) a power supply for establishing a potential between the cathode and the anode. In some embodiments, the fuel inlet is in electrical contact with the liquid metal anode. In some embodiments, the apparatus further comprises a cooling tube extending upwardly from the anode. In some embodiments, the electrolyte is molten.

In another aspect, the invention comprises an apparatus for producing metal from mixtures comprising metal oxides comprising a container comprising a) a cathode in electrical contact with an electrolyte; b) a liquid metal anode separated from the cathode and the electrolyte by a solid oxygen ion conducting membrane; c) a fuel inlet tube in proximity to the liquid metal anode, the fuel inlet tube comprising a material that maintains its structural integrity in a reducing environment; and d) a power supply for establishing a potential between the cathode and the anode. In some embodiments, the fuel inlet is in electrical contact with the liquid metal anode. In some embodiments, the apparatus further comprises a cooling tube extending upwardly from the anode. In some embodiments, the electrolyte is molten.

BRIEF DESCRIPTION OF THE DRAWINGS

The following figures are illustrative only and are not intended to be limiting.

DETAILED DESCRIPTION

Described herein are methods and apparatuses useful for obtaining metals from metal oxides.

DEFINITIONS

As used herein and in the appended claims, the singular forms "a," "an," and "the" include plural references unless the content clearly dictates otherwise.

The term "about" is used herein to mean approximately, in the region of, roughly, or around. When the term "about" is used in conjunction with a numerical range, it modifies that range by extending the boundaries above and below the numerical values set forth. The term "about" is used herein to modify a numerical value above and below the stated value by a variance of 20%.

The term "reducing environment" as used herein means an operating condition in which oxidation is substantially reduced or prevented. One of skill in the art understands that there is a range of reducing environments. The term "somewhat reducing" environment as used herein means the useful range of operating conditions between metal oxidation and very incomplete fuel combustion. For example, at 1200° C., nickel does not oxidize at an oxygen partial pressure below about $10^{-8}$ atm, corresponding to an $H_2/H_2O$ ratio around $10^{-2}$, i.e. 99% combustion of hydrogen; but it is not useful to operate with oxygen partial pressure below about $10^{-12}$ atm, corresponding to $H_2/H_2O$ ratio around 1.3, i.e. only about 40% combustion of hydrogen, which would be a very inefficient use of fuel. Therefore at 1200° C., the useful window of oxygen partial pressure for hydrogen fuel with a nickel fuel inlet and current collector would be about $10^{-12}$ and $10^{-8}$ atm. At this temperature, this oxygen partial pressure range also corresponds to $CO/CO_2$ ratio between about 1 and 0.05, i.e. 50-95% combustion of CO.

Likewise, liquid aluminum is a poor choice of anode material, because at 1200° C. it would require a $CO/CO_2$ ratio of $10^{13}$, or $H_2/H_2O$ ratio around $10^{12}$. It would be nearly impossible, and certainly very impractical, to maintain enough fuel flow to prevent oxidation of the aluminum. Aluminum is stable in a strongly reducing environment, not in the more useful "somewhat reducing" environment as defined in the previous paragraph. By way of non-limiting example, for a nickel fuel inlet and current collector with a liquid copper anode at 1200° C., optimal combustion conditions would result in about 90% combustion of fuel. For example with natural gas fuel, the ionic current to fuel feed ratio would establish a $O:CH_4$ ratio of 3.6:1. This is 90% of the 4:1 stoichiometric combustion ratio, and therefore uses most of the energy of the fuel. This ratio also leaves more than enough $H_2$ and CO in the combustion product to prevent oxidation of the both the nickel fuel inlet/current collector and also the liquid copper anode.

Figure 1:
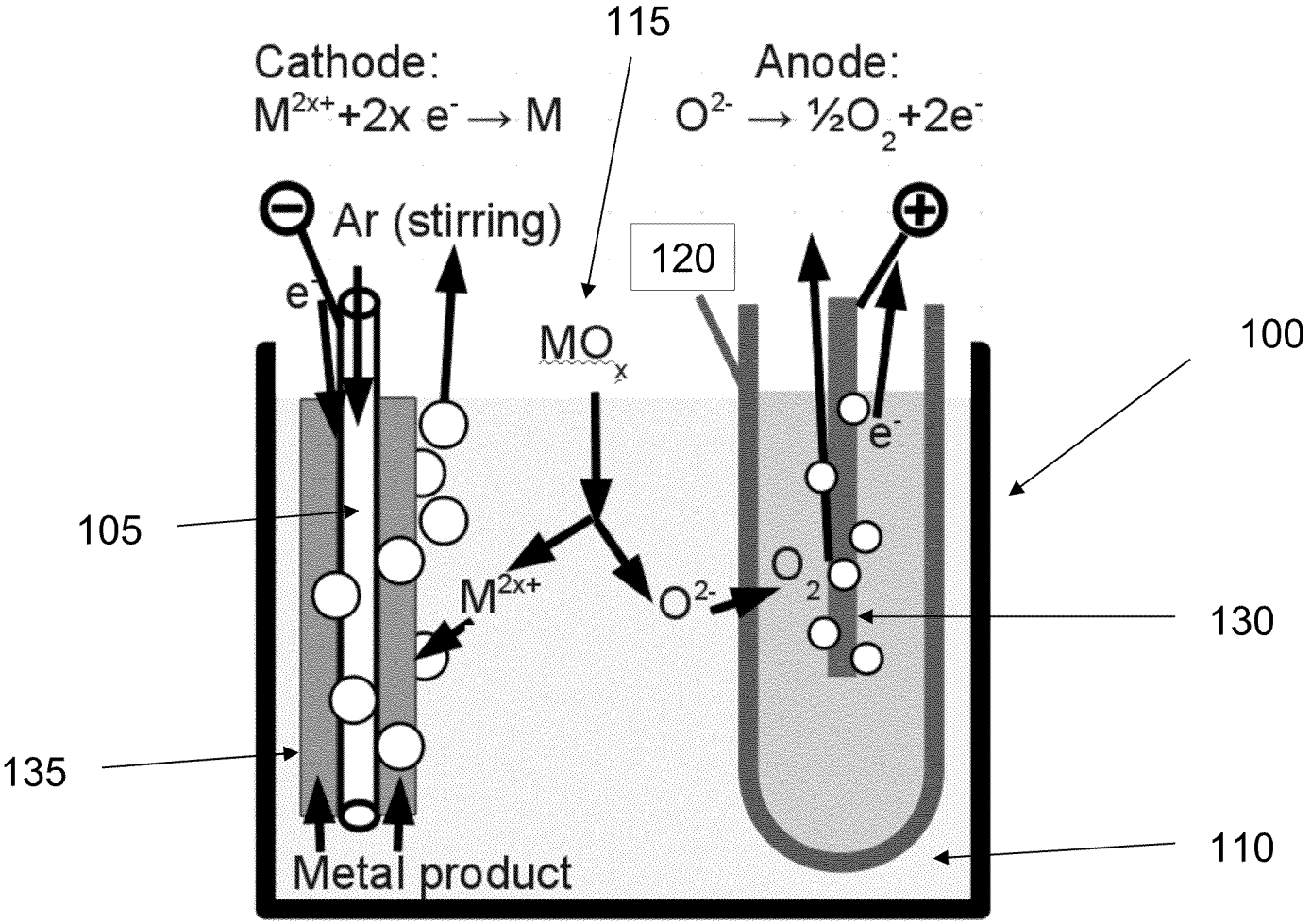
FIG. 1. A schematic illustration of an SOM process for making metal and oxygen from a metal oxide.

Recent development of the solid oxide membrane (SOM) electrolysis process has provided an alternative method for refinement of metal oxides (see, for example, U.S. Pat. Nos. 5,976,345, and 6,299,742; each herein incorporated by reference in its entirety). The process as applied to metal production is shown in FIG. 1. The apparatus 100 consists of a metal cathode 105, a molten salt electrolyte bath 110 that dissolves the metal oxide (115) which is in electrical contact with the cathode, a solid oxygen ion conducting membrane (SOM) 120 typically consisting of zirconia stabilized by yttria (YSZ) or other low valence oxide-stabilized zirconia, for example, magnesia- or calcia-stabilized zirconia (MSZ or CSZ, respectively) in ion-conducting contact with the molten salt bath 110, an inert anode 130 in ion-conducting contact with the solid oxygen ion-conducting membrane, and a power source for establishing a potential between the cathode and anode. The power source can be any of the power sources suitable for use with SOM electrolysis processes and are known in the art.

The metal cations are reduced to metal (135) at the cathode, and oxygen ions migrate through the membrane to the anode where they are oxidized to produce oxygen gas. The SOM blocks back-reaction between anode and cathode products. It also blocks ion cycling, which is the tendency for subvalent cations to be re-oxidized at the anode, by removing the connection between the anode and the metal ion containing molten salt because the SOM conducts only oxide ions, not electrons (see, U.S. Pat. Nos. 5,976,345, and 6,299,742; each herein incorporated by reference in its entirety); however the process runs at high temperatures, typically 1000-1300° C. in order to maintain high ionic conductivity of the SOM. The anode must have good electrical conductivity at the process temperature while exposed to pure oxygen gas at approximately 1 atm pressures.

The best technical approach so far has been to use either an oxygen-stable liquid metal, such as silver or its alloys with dilute copper, tin, etc., or oxygen stable electronic oxides, oxygen stable cermets, and stabilized zirconia composites with oxygen stable electronic oxides as the anode (PCT/US06/027255; herein incorporated by reference in its entirety). If the anode is a liquid metal, then the oxygen produced at the anode accumulates in the metal until oxygen evaporation rate balances the rate of oxygen production. Liquid metal anodes have the advantage of excellent electronic conductivity (around 10,000 S/cm for liquid silver), simplicity and robustness. Gas permeability is relatively good as long as oxygen bubbles can form easily. However, oxygen-stable liquid metal anode candidates are typically limited to silver and gold, which are of considerable expense.

However, a gaseous fuel bubbled through the liquid metal, or a carbon source introduced into the liquid metal, can provide a reducing environment to protect an anode which would otherwise oxidize, as with the natural gas through porous carbon approach to the Hall-Héroult cell mentioned above. The fuel reacts with the oxygen in the liquid metal and reduces its chemical potential there. This in turn reduces the required voltage for production of the metal, effectively substituting chemical energy for electrical energy (See, e.g., Pal et al., *JOM* 59(5): 44-49 (2007); Krisnan et al, *Metall. Mater. Trans.* 36B:463-473 (2005); Pal in "Solid Oxygen Ion Conducting Membrane Technology for Direct Reduction of Magnesium from its Oxide at High Temperatures," in U.S. Dept. of Energy Automotive Lightweighting Materials 2001 Annual Progress Report; Pal et al, *JOM* 53(10):32-35 (2001); and Ajay Krisnan, Solid Oxide Membrane Process for Direct Reduction of Magnesium from Magnesium Oxide, Boston University Manufacturing Engineering Ph.D. Thesis, 2006; each herein incorporated by reference in its entirety). Liquid anodes have been used in fuel cell devices for energy storage and energy generation (U.S. Pat. No. 7,678,484; herein incorporated by reference in its entirety), however application in the context of metal production has not been performed. Herein, apparatuses and processes for metal production using liquid anodes that are comprised of materials that are stable to oxidation.

Figure 2:
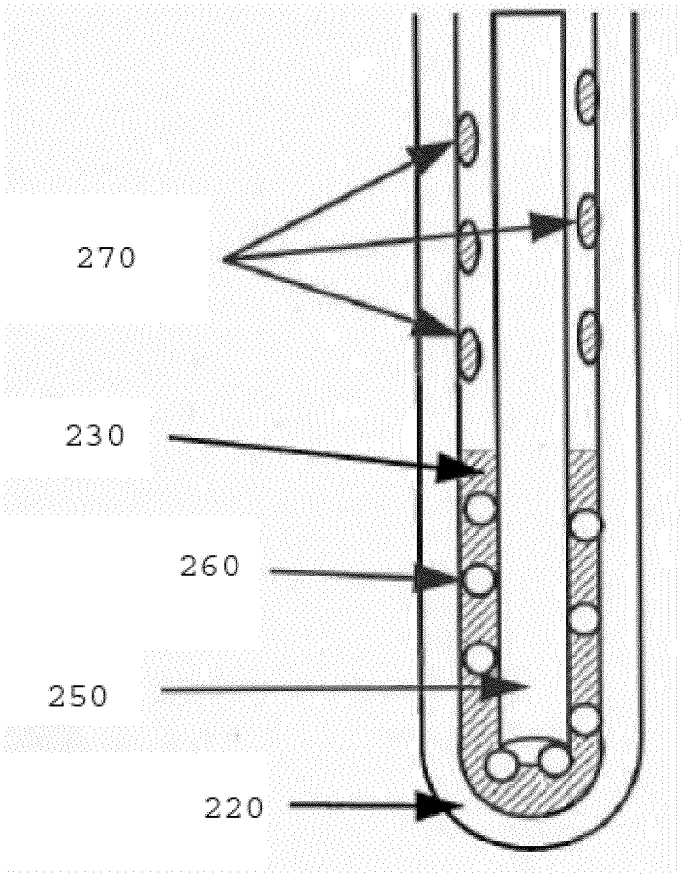
FIG. 2. A illustrative embodiment of an SOM and anode configuration for producing metal from a metal oxide according to an embodiment of the invention.

Embodiments of the invention involve the use of liquid anodes, the materials and configurations of solid metal tube current collectors/fuel inlets, and fuel requirements. These anode systems have the advantages of simplicity and robustness, and excellent compatibility with a zirconia solid electrolyte between them and the salt, in which the zirconia electrolyte exhibits large grain size for molten salt corrosion resistance. Further advantages include minimal to no generation of metal oxide and/or requiring no water vapor or other oxidizing agent in order to prevent problematic carbon accumulation in the system. FIG. 2 shows an embodiment of an anode/SOM configuration of the invention. FIG. 2 shows a liquid anode (230) for use with embodiments of the present invention. The anode 230 is in ion-conducting contact with the solid oxygen ion-conducting membrane (220). The liquid anode contains dissolved oxygen from oxygen influx through the SOM membrane. Fuel enters through the fuel tube (250) and bubbles with fuel and combustion products (260) rise through the liquid anode. Condensed droplets of anode material (270) drip down to the anode. The fuel tube can optionally also serve as the current collector.

In some embodiments, the fuel inlet tube is in electrical contact with the liquid metal anode and conveys the electrical potential to the liquid metal anode, the material comprising the fuel inlet tube maintaining its electrical conductivity in a reducing environment.

In some embodiments, the material comprising the fuel inlet tube and physical dimensions of the fuel inlet tube maintain an electrical resistance between the liquid metal anode and a source of the electrical potential of below 1 ohm.

In some embodiments, the methods or apparatus comprise at least two fuel inlet tubes, wherein the material comprising the at least two fuel inlet tubes and physical dimensions of the fuel inlet tubes maintain an electrical resistance between the liquid metal anode and a source of the electrical potential of below about 1 ohm.

In some embodiments, the methods or apparatus further comprise one or more current collectors in electrical contact with the liquid metal anode, the one or more current collectors conveying the electrical potential to the liquid metal anode, and the one or more current collectors comprising a material that maintains its electrical conductivity in a reducing environment.

In some embodiments, the material comprising the one or more current collectors and physical dimensions of the current collectors maintain an electrical resistance between the liquid metal anode and a source of the electrical potential of below about 1 ohm.

In some embodiments, the reducing environment has an oxygen partial pressure of less than about $10^{-4}$ atmospheres.

In some embodiments, oxidation of the anode or fuel inlet tube is prevented.

For liquid anodes with high vapor pressure such as silver or bismuth, this SOM anode invention incorporates an extended tube carrying oxygen gas or combustion products away from the anode in a direction with an upward component, i.e. straight up or diagonally upward, and in which the maximum gas cooling rate (the product of its velocity and the temperature gradient along the tube) is less than or equal to about 300° C./second. Given a typical gas phase diffusivity of about 1 $cm^2/s$ and tube diameter about 2 cm, this cooling rate provides sufficient cooling time while the gas is above the anode melting point to transport the anode vapor to the tube walls, where it condenses and flows back down into the SOM anode. Thus, some embodiments reduce or prevent formation of particles other waste carried out of solution by combustion gases. The vapor pressure of the remaining anode vapor which does not condense as a liquid is not far above the melting point vapor pressure, resulting in very slow loss rates of the anode material as a solid or oxide deposit in the tube walls. Thus, in some embodiments, the apparatus and/or method comprises a cooling tube extending upwardly from the anode. In some embodiments, combustion products are cooled in the tube. In some embodiments, anode vapor is condensed in the tube.

In some embodiments, maximum gas cooling rate is less than about 300° C./second. In some embodiments, maximum gas cooling rate is less than about 270° C./second. In some embodiments, maximum gas cooling rate is less than about 250° C./second. In some embodiments, maximum gas cooling rate is less than about 230° C./second. In some embodiments, maximum gas cooling rate is less than about 200° C./second.

As mentioned above herein, bubbling fuel through the liquid anode provides a reducing environment, such that one can use materials for the anode and tube current collectors/fuel inlets which are not stable in a pure oxygen environment. Liquid metal anodes are described, for example, in *J. Electrochemical Society,* 2009, 156(9), B1067-B1077 and *Int. J. Hydrogen Energy* 26 (2011), 152-159; each herein incorporated by reference in its entirety). Exemplary materials for the liquid metal anode include silver, copper, tin or bismuth, or alloys mostly comprised (for example, greater than about 60% by weight) of these metals. Thus, in some embodiments, the liquid metal anode comprises silver, copper, tin, bismuth or alloys comprising silver, copper, tin or bismuth. In some embodiments, the liquid metal anode comprises copper, tin, bismuth or alloys comprising copper, tin or bismuth. In some embodiments, the liquid metal anode comprises silver, copper, tin, or bismuth. In some embodiments, the liquid metal anode comprises copper, tin, or bismuth. In some embodiments, the liquid metal anode comprises alloys of silver, copper, tin, or bismuth. In some embodiments, the liquid metal anode comprises alloys of copper, tin, or bismuth. In some embodiments, the alloys comprise greater than about 60% silver, copper, tin, or bismuth. In some embodiments, the alloys comprise greater than about 60% copper, tin, or bismuth. In some embodiments, the alloys comprise greater than about 70% silver, copper, tin, or bismuth. In some embodiments, the alloys comprise greater than about 70% copper, tin, or bismuth. In some embodiments, the alloys comprise greater than about 80% silver, copper, tin, or bismuth. In some embodiments, the alloys comprise greater than about 80% copper, tin, or bismuth. In some embodiments, the alloys comprise greater than about 90% silver, copper, tin, or bismuth. In some embodiments, the alloys comprise greater than about 90% copper, tin, or bismuth.

The methods and apparatus can comprise more than one cathode, current collector and/or fuel inlet.

In some embodiments, the fuel inlet and current collector are separate elements. Thus, in some embodiments, the method or apparatus further comprises a current collector. In other embodiments however, the fuel inlet also operates as the current collector. In some embodiments, the fuel inlet is in electrical contact with the anode. In some embodiments, the current collector is in electrical contact with the anode. In some embodiments, the current collector is electrically conductive in a reducing environment. In some embodiments, the fuel inlet is electrically conductive in a reducing environment.

The current collector and/or fuel inlet has a resistance of about 1 ohm or less. In some embodiments, the resistance is about 0.5 ohm or less. In some embodiments, the resistance is about 0.1 ohm or less. In some embodiments, the resistance is about 0.05 ohm or less. In some embodiments, the resistance is about 0.01 ohm or less. In some embodiments, the resistance is about 0.005 ohm or less.

Exemplary materials for current collectors and/or fuel inlets include graphite, nickel, cobalt, iron, chromium, manganese, molybdenum, tungsten, niobium, iridium, titanium, or alloys mostly comprised (for example, greater than about 60% by weight) of those elements, or other materials coated with these elements or coated with alloys mostly comprised of them. Thus, in some embodiments, the current collector and/or fuel inlet is comprised of graphite, nickel, cobalt, iron, chromium, manganese, molybdenum, tungsten, niobium, iridium or titanium. In some embodiments, the current collector and/or fuel inlet is comprised of nickel, cobalt, iron, chromium, manganese, molybdenum, tungsten, niobium, iridium or titanium. In some embodiments, the current collector and/or fuel inlet is comprised of nickel, cobalt, iron, chromium, manganese, molybdenum, tungsten, niobium, or iridium.

In some embodiments, the current collector and/or fuel inlet is comprised of alloys of graphite, nickel, cobalt, iron, chromium, manganese, molybdenum, tungsten, niobium, iridium, titanium, aluminum or silicon. In some embodiments, the current collector and/or fuel inlet is comprised of alloys of nickel, cobalt, iron, chromium, manganese, molybdenum, tungsten, niobium, iridium, titanium, aluminum or silicon. In some embodiments, the current collector and/or fuel inlet is comprised of alloys of nickel, cobalt, iron, chromium, manganese, molybdenum, tungsten, niobium, iridium or titanium. In some embodiments, the current collector and/or fuel inlet is comprised of alloys of nickel, cobalt, iron, chromium, manganese, molybdenum, tungsten, niobium, or iridium. In some embodiments, the fuel inlet is comprised of materials stable in the reducing environment but not electrically conducting, such as non-oxide ceramics e.g. boron nitride. The fuel inlet need not contact the liquid metal anode in order to inject fuel, for example it can create a fuel jet which reacts with oxygen in the liquid metal anode In some embodiments, the current collector and/or fuel inlet is comprised of materials coated with graphite, nickel, cobalt, iron, chromium, manganese, molybdenum, tungsten, niobium, iridium or titanium. In some embodiments, the current collector and/or fuel inlet is comprised of materials coated with nickel, cobalt, iron, chromium, manganese, molybdenum, tungsten, niobium, iridium or titanium. In some embodiments, the current collector and/or fuel inlet is comprised of materials coated with nickel, cobalt, iron, chromium, manganese, molybdenum, tungsten, niobium, or iridium.

In some embodiments, the current collector and/or fuel inlet is comprised of materials coated with alloys of graphite, nickel, cobalt, iron, chromium, manganese, molybdenum, tungsten, niobium, iridium, titanium, aluminum or silicon. In some embodiments, the current collector and/or fuel inlet is comprised of materials coated with alloys of nickel, cobalt, iron, chromium, manganese, molybdenum, tungsten, niobium, iridium, titanium, aluminum or silicon. In some embodiments, the current collector and/or fuel inlet is comprised of materials coated with alloys of nickel, cobalt, iron, chromium, manganese, molybdenum, tungsten, niobium, iridium or titanium. In some embodiments, the current collector and/or fuel inlet is comprised of materials coated with alloys of nickel, cobalt, iron, chromium, manganese, molybdenum, tungsten, niobium, or iridium.

Exemplary combinations of current collectors and/or fuel inlets and anodes that do not react appreciably include: nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, and iridium-copper. Thus, in some embodiments, the current collector and/or fuel inlet and anode combination comprises nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, or iridium-copper. Other combinations of current collector/fuel inlet and anode are obtained from combination of current collector and/or fuel inlets and anodes indicated herein, and are also within the scope of the invention.

While some embodiments of the invention can use pure hydrogen as a fuel for metal reduction, other embodiments of the invention use syngas (a mixture of hydrogen and CO), natural gas, a mixture of natural gas and steam, and/or other gaseous carbon fuels such as carbon dioxide. Other embodiments use solid sources of carbon, such as graphite, coal powder and high-density hydrocarbon plastics. Use of such fuels requires sufficient oxygen or water at the inlet and hydrogen and oxygen at the exit to prevent or minimize deposition of carbon or sulfur in the inlet and exit, known as "coking". The conditions can be summarized as follows.

The inlet gas must contain at least as many oxygen atoms or water molecules as carbon atoms in order to reduce or prevent coking in the inlet, i.e. at least a 1:1 ratio of oxygen atoms to carbon atoms in the fuel. It can be further advantageous if this ratio of oxygen to carbon atoms is at least 2:1. Alternatively, one may use an inlet tube material or liner which suppresses the formation of carbon there. A third alternative to prevent inlet coking would be to rapidly inject natural gas with or without steam directly into the liquid metal, where it cracks to carbon and hydrogen, and both react with the oxygen in the liquid metal.

The inlet must provide sufficient fuel relative to oxygen to maintain a reducing environment which prevents the oxidation of the liquid anode or fuel inlet/current collector. For most of the above materials at the process temperature, this will be a minimum $CO/CO_2$ ratio and $H_2/H_2O$ ratio around about 1:10 to 1:5, where the ratio is determined by the rate of fuel feeding, the oxygen provided with the fuel (e.g. as steam or CO), and the oxygen introduced by the ionic current flowing through the solid electrolyte into the anode. The minimum ratio will depend on the metals used, e.g. silver and iridium do not oxidize in much lower ratios of $CO/CO_2$ and $H_2/H_2O$ than about 1:10, or even pure oxygen, whereas iron and chromium require higher minimum ratios. Having been made aware of the importance of these ratios, those skilled in the art can determine the minimum ratio required at the operating temperature for a given anode and current collector using such tools as the Ellingham diagram.

When either or both of the current collector and/or fuel inlet and anode is not stable in oxygen, for example, when the current collector/fuel inlet or anode materials are oxidized in the presence of oxygen, the fuel must contain sufficient hydrogen to form steam which prevents exit coking, which is at least about a 1:1 $H_2/CO$ ratio, i.e. about a 2:1 ratio of hydrogen to carbon atoms in the fuel mixture. This ensures that even with an exit $CO/CO_2$ ratio as high as about 1:1, there is at least as much water as CO, such that CO reacts with water to produce $CO_2$ and $H_2$, instead of CO forming $CO_2$ and carbon deposits. Likewise, solid and liquid carbon sources such as coal, charcoal, biomass (wood, paper, etc.), post-consumer plastics, and others can fuel the reaction, optionally with steam, as long as the input fuel-steam mixture satisfies the hydrogen/carbon atom ratio of about 2:1. Those skilled in the art know of various techniques for delivering these solid or liquid fuels into the anode. Exemplary techniques include pressurized injection and others known to those in the art, such as described in Soobhanker et al. (*Int. J. Hydrocarbon Energy* 2011, 36, 152-159; incorporated herein by reference in its entirety). The liquid metal anode provides suitable catalytic activity for in situ reforming of any these fuels into hydrogen and CO, and the steam in the fuel mixture and/or oxygen introduced by the ionic current flowing through the SOM process provide sufficient oxidation to prevent coking in the exit.

In some embodiments, the gases are mixed prior to being fed into the process. In some embodiments, the gases are mixed via diffusion. In some embodiments, the gases are actively pumped into the fuel inlet. In some embodiments, the gases are jetted into the fuel inlet.

In some embodiments, potential is used to control oxygen feed into the liquid anode. In some embodiments, potential is controlled to modulate oxygen production. By way of non-limiting example, increased voltage results in increased oxygen flow to the anode. Conversely, if there is too much oxygen or an oxidizing environment, voltage can be reduced to reduce oxygen flux into the anode. Those skilled in the art are aware of standard methods to detect oxygen concentration in the combustion product, thus indicating to the artisan whether to increase or decrease potential.

In some embodiments, methods further comprise collecting the metallic species. Methods of collecting metallic species are known (See, e.g., Krisnan et al, *Metall. Mater. Trans.* 36B:463-473 (2005); Krisnan et al, *Scan. J. Metall.* 34(5): 293-301 (2005); and U.S. Pat. No. 400,664; each herein incorporated by reference in its entirety).

Figure 3:
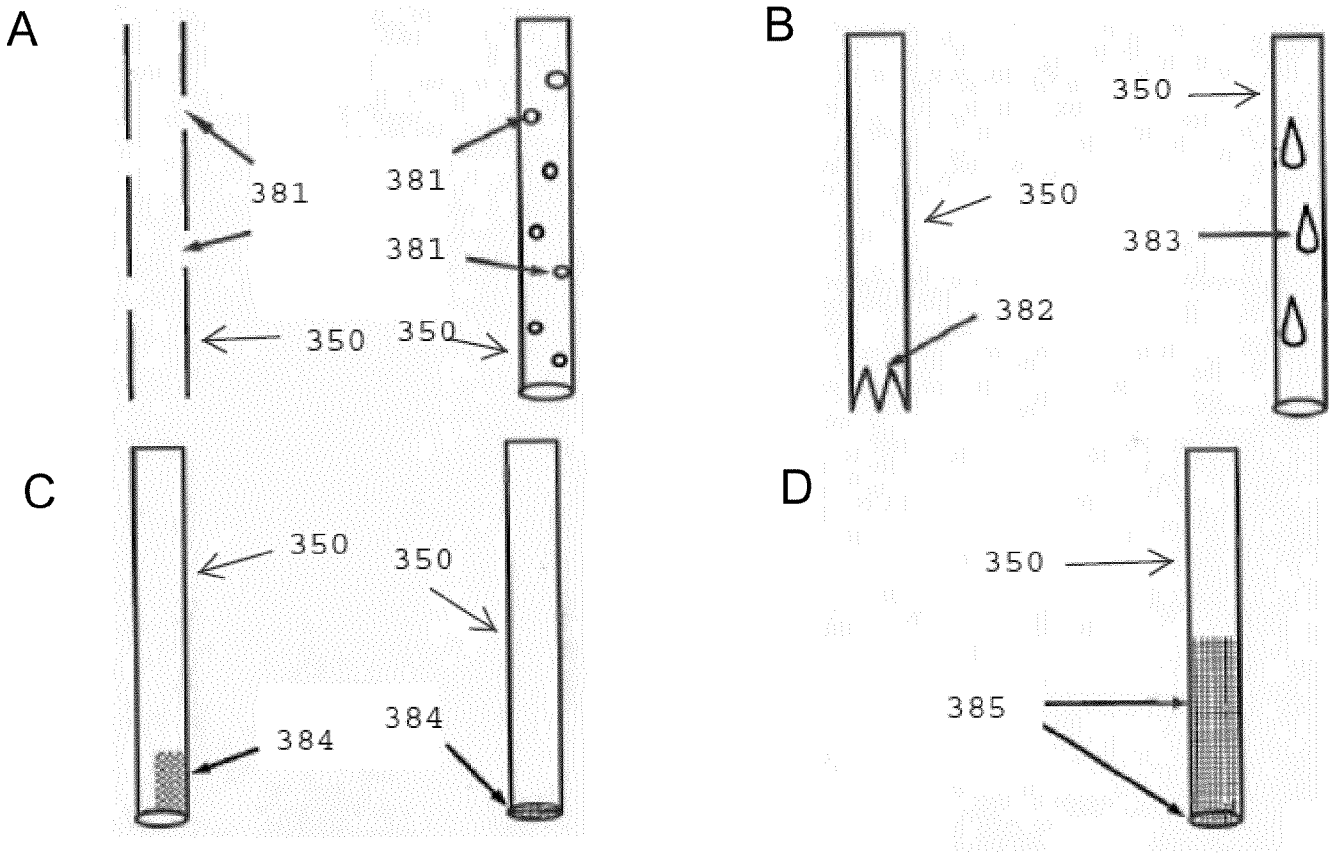
FIG. 3. A schematic illustration of embodiments of fuel inlet tube/current collector configurations according to embodiments of the invention.

High anode surface tension can impede bubble formation for feeding a gaseous fuel into the liquid anode. For this reason, embodiments of the invention comprise configurations of fuel inletand/or current collector tubes which reduce bubble size for this application. Exemplary configurations shown in FIG. 3 include small holes (381) in the fuel inlet tube (350) (FIG. 3A); one or more acute-angle notch(es) (382) in the fuel inlet tube, or such angular notches in holes (383) in the fuel inlet (FIG. 3B); mesh or screen with or without similar acute angles (384) needed to promote small bubble size (FIG. 3C); and a porous tube with pores (385) (FIG. 3D). Thus, in some embodiments, the fuel inlet and/or current collector configuration is selected from a tube comprising holes, a tube comprising notches at the tube end, a tube comprising notched holes, a tube comprising a mesh screen, and/or a porous tube material. In some embodiments, the notches, holes or pores are about 0.5-2 mm in diameter. In some embodiments, the notches, holes or pores are less than about 0.5 mm in diameter.

Another way to promote small bubble formation is to use fuel containing at least 0.5% sulfur by weight, as some of this sulfur dissolves in many of the liquid anode materials, reducing the anode surface tension. Many carbon fuels such as natural gas and coal contain sulfur. Thus, in some embodiments, the fuel comprises sulfur.

In some embodiments, fuel reforming can use the exhaust product from the anode. In some embodiments, the exhaust product containing carbon monoxide is mixed with fuel for metal production. Analogous methods are used in fuel cell applications where gas is used in reforming. The fuel reforming process further increases efficiency and can also eliminate coking at the inlet. In some embodiments, the exhaust product is partially combusted. In some embodiments, steam and/or carbon dioxide is injected.

In some embodiments, the molten salt is at least about 90% liquid. In some embodiments, the molten salt is at least about 92% liquid. In some embodiments, the molten salt is at least about 95% liquid. In some embodiments, the molten salt is at least about 98% liquid. In some embodiments, the molten salt is at least about 99% liquid.

In some embodiments, the processes and apparatuses described herein entail the use of modified SOM processes that enable extraction of metals from metal oxides. Representative embodiments of the SOM apparatus and process may be found, for example, in U.S. Pat. Nos. 5,976,345; 6,299,742; and *Mineral Processing and Extractive Metallurgy* 117 (2):118-122 (June 2008); *JOM Journal of the Minerals, Metals and Materials Society* 59(5):44-49 (May 2007); *Metall. Mater. Trans.* 36B:463-473 (2005); *Scand. J. Metall.* 34(5): 293-301 (2005); and International Patent Application Publication Nos. WO 2007/011669 and WO 2010/126597; each of which hereby incorporated by reference in its entirety.

In some embodiments, the molten salt is at a temperature of from about 700° C. to about 2000° C. In some embodiments, the molten salt is at a temperature of from about 700° C. to about 1600° C. In some embodiments, the molten salt is at a temperature of from about 700° C. to about 1300° C. In some embodiments, the molten salt is at a temperature of from about 700° C. to about 1200° C. In some embodiments, the molten salt is at a temperature of from about 1000° C. to about 1300° C. In some embodiments, the molten salt is at a temperature of from about 1000° C. to about 1200° C.

It will recognized that one or more features of any embodiments disclosed herein may be combined and/or rearranged within the scope of the invention to produce further embodiments that are also within the scope of the invention.

Those skilled in the art will recognize, or be able to ascertain using no more than routine experimentation, many equivalents to the specific embodiments of the invention described herein. Such equivalents are also intended to be within the scope of the present invention.

As will be apparent to one of ordinary skill in the art from a reading of this disclosure, further embodiments of the present invention can be presented in forms other than those specifically disclosed above. The particular embodiments described above are, therefore, to be considered as illustrative and not restrictive. Those skilled in the art will recognize, or be able to ascertain, using no more than routine experimentation, numerous equivalents to the specific embodiments described herein. Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways within the scope and spirit of the invention. The scope of the invention is as set forth in the appended claims and equivalents thereof, rather than being limited to the examples contained in the foregoing description.

What is claimed is:

1. A method for producing a metal from a metal oxide comprising:

(a) providing a cathode in electrical contact with a molten electrolyte comprising a metal oxide;

(b) providing a liquid metal anode separated from the cathode and the molten electrolyte by a solid oxygen ion conducting membrane;

(c) providing a fuel inlet tube having an outlet end in proximity to the liquid metal anode, the fuel inlet tube comprising a material that maintains its structural integrity in a reducing environment;

(d) delivering a gaseous fuel comprising hydrogen to the liquid metal anode via the fuel inlet tube;

(e) establishing a potential between the cathode and the liquid metal anode; and (f) providing one or more current collectors in electrical contact with the liquid metal anode, the one or more current collectors conveying the electrical potential to the liquid metal anode, and the one or more current collectors comprising a material that maintains its electrical conductivity in a reducing environment;

wherein the combination of the one or more current collectors and liquid metal anode comprises at least one of nickel-bismuth, cobalt-silver, cobalt-copper, cobalt-bismuth, iron-silver, iron-copper, iron-bismuth, chromium-copper, chromium-bismuth, manganese-silver, molybdenum-bismuth, tungsten-silver, tungsten-copper, niobium-silver, niobium-copper, niobium-bismuth, and iridium-copper.

2. The method of claim 1, wherein the fuel inlet tube is in electrical contact with the liquid metal anode and conveys the electrical potential to the liquid metal anode, the material comprising the fuel inlet tube maintaining its electrical conductivity in a reducing environment.

3. The method of claim 2, wherein the material comprising the fuel inlet tube and physical dimensions of the fuel inlet tube maintain an electrical resistance between the liquid metal anode and a source of the electrical potential of below about 1 ohm.

4. The method of claim 2, comprising at least two fuel inlet tubes, wherein the material comprising the at least two fuel inlet tubes and physical dimensions of the fuel inlet tubes maintain an electrical resistance between the liquid metal anode and a source of the electrical potential of below about 1 ohm.

5. The method of claim 1, wherein the material comprising the one or more current collectors and physical dimensions of the current collectors maintain an electrical resistance between the liquid metal anode and a source of the electrical potential of below about 1 ohm.

6. The method of claim 1, wherein the reducing environment has an oxygen partial pressure of less than about $10^{-4}$ atmospheres.

7. The method of claim 1, wherein oxidation of the anode or fuel inlet tube is prevented.

8. The method of claim 1, wherein deposition of carbon or sulfur in the inlet and exit is prevented.

9. The method of claim 1, wherein the fuel comprises at least about a 2:1 ratio of hydrogen to carbon atoms.

10. The method of claim 1, wherein the fuel comprises at least a 1:1 ratio of oxygen atoms to carbon atoms.

11. The method of claim 1, wherein sufficient fuel relative to oxygen is provided such that oxidation of the liquid anode or fuel inlet is prevented.

12. The method of claim 1, further comprising collecting the metallic species.

13. The method of claim 1, wherein the fuel inlet tube configuration is selected from at least one of a tube comprising holes, a tube comprising notches at a tube end in electrical contact with the liquid metal anode, a tube comprising notched holes, a tube comprising a mesh screen, and a porous tube material.

14. The method of claim 1, wherein the liquid metal anode is comprised of at least one of copper, bismuth, and alloys comprised of greater than about 60% by weight of copper or bismuth.

15. The method of claim 1, wherein the fuel inlet tube comprises at least one of nickel, cobalt, iron, chromium, manganese, molybdenum, tungsten, niobium, iridium, titanium; alloys comprised of greater than about 60% by weight of nickel, cobalt, iron, chromium, manganese, molybdenum, tungsten, niobium, iridium, titanium, aluminum or silicon; materials coated with nickel, cobalt, iron, chromium, manganese, molybdenum, tungsten, niobium, iridium, titanium, and materials coated with alloys comprised of greater than about 60% by weight of nickel, cobalt, iron, chromium, manganese, molybdenum, tungsten, niobium, iridium, titanium, aluminum or silicon.

16. The method of claim 1, wherein the combination of the one or more current collectors and liquid metal anode comprises at least one of cobalt-copper, cobalt-bismuth, iron-copper, iron-bismuth, chromium-copper, chromium-bismuth, molybdenum-bismuth, tungsten-copper, niobium-copper, niobium-bismuth, and iridium-copper.

17. The method of claim 1, wherein the fuel comprises hydrogen and carbon.

18. The method of claim 1, wherein the fuel comprises at least one of syngas, natural gas, a mixture of natural gas and steam and a mixture of natural gas and carbon dioxide.

19. The method of claim 1, wherein at least a portion of an exhaust product produced during the production of the metal from the metal oxide is mixed with the gaseous fuel.

20. The method of claim 1, further comprising controlling the electrical potential to modulate oxygen production.

21. The method of claim 1, wherein coking is reduced or prevented.

22. The method of claim 1, wherein fuel inlet and/or current collector is protected from oxidation.

23. An apparatus for producing a metal from a metal oxide comprising:

(a) an electrolyte container for holding an electrolyte;

(b) a cathode disposed in the electrolyte container;

(c) a liquid metal anode container for holding a liquid metal anode and for maintaining the liquid metal anode separate from the cathode and the electrolyte, at least a portion of the liquid metal anode container comprising a solid oxygen ion conducting membrane;

(d) a fuel inlet tube having an outlet disposed in the liquid metal anode container, the fuel inlet tube comprising a material that maintains its structural integrity in a reducing environment;

(e) a power supply for establishing a potential between the cathode and the anode; and (f) one or more current collectors in electrical contact with the liquid metal anode and comprising a material that maintains its electrical conductivity in a reducing environment;

wherein the combination of the one or more current collectors and liquid metal anode comprises at least one of nickel-bismuth, cobalt-silver, cobalt-copper, cobalt-bismuth, iron-silver, iron-copper, iron-bismuth, chromium-copper, chromium-bismuth, manganese-silver, molybdenum-bismuth, tungsten-silver, tungsten-copper, niobium-silver, niobium-copper, niobium-bismuth, and iridium-copper.

24. The apparatus of claim 23, wherein the fuel inlet tube is in electrical contact with the liquid metal anode disposed in the liquid metal anode container and conveys the electrical potential to the liquid metal anode, the material comprising the fuel inlet tube maintaining its electrical conductivity in a reducing environment.

25. The apparatus of claim 24, wherein the material comprising the fuel inlet tube and physical dimensions of the fuel inlet tube maintain an electrical resistance between the liquid metal anode disposed in the liquid metal anode container and a source of the electrical potential of below about 1 ohm.

26. The apparatus of claim 24, comprising at least two fuel inlet tubes, wherein the material comprising the at least two fuel inlet tubes and physical dimensions of the fuel inlet tubes maintain an electrical resistance between the liquid metal anode disposed in the liquid metal anode container and a source of the electrical potential of below about 1 ohm.

27. The apparatus of claim 23, wherein the material comprising the one or more current collectors and physical dimensions of the current collectors maintain an electrical resistance between the liquid metal anode and a source of the electrical potential of below about 1 ohm.

28. The apparatus of claim 23, wherein the material comprising the fuel inlet tube maintains its structural integrity in a reducing environment having an oxygen partial pressure of less than about $10^{-4}$ atmospheres.

29. The apparatus of claim 23, wherein the fuel inlet configuration is selected from at least one of a tube comprising holes, a tube comprising notches at a tube end in electrical contact with the liquid metal anode, a tube comprising notched holes, a tube comprising a mesh screen, and a porous tube material.

30. The apparatus of claim 23, wherein the liquid metal anode is comprised of at least one of copper, bismuth, and alloys comprised of greater than about 60% by weight of copper or bismuth.

31. The apparatus of claim 23, wherein the fuel inlet comprises of at least one of nickel, cobalt, iron, chromium, manganese, molybdenum, tungsten, niobium, iridium, titanium; alloys comprised of greater than about 60% by weight of nickel, cobalt, iron, chromium, manganese, molybdenum, tungsten, niobium, iridium, titanium, aluminum or silicon; materials coated with nickel, cobalt, iron, chromium, manganese, molybdenum, tungsten, niobium, iridium, titanium, and materials coated with alloys comprised of greater than about 60% by weight of nickel, cobalt, iron, chromium, manganese, molybdenum, tungsten, niobium, iridium, titanium, aluminum or silicon.

32. The apparatus of claim 23, wherein the combination of the one or more current collectors and liquid metal anode comprises at least one of cobalt-copper, cobalt-bismuth, iron-copper, iron-bismuth, chromium-copper, chromium-bismuth, molybdenum-bismuth, tungsten-copper, niobium-copper, niobium-bismuth, and iridium-copper.

33. A method for producing a metal from a metal oxide comprising:

(a) providing a cathode in electrical contact with a molten electrolyte comprising a metal oxide;

(b) providing a liquid metal anode separated from the cathode and the molten electrolyte by a solid oxygen ion conducting membrane;

(c) providing a fuel inlet tube having an outlet end in proximity to the liquid metal anode, the fuel inlet tube comprising a material that maintains its structural integrity in a reducing environment; wherein the fuel inlet tube configuration is selected from at least one of a tube comprising holes, a tube comprising notches at a tube end in electrical contact with the liquid metal anode, and a tube comprising notched holes;

(d) delivering a gaseous fuel comprising hydrogen to the liquid metal anode via the fuel inlet tube; and (e) establishing a potential between the cathode and the liquid metal anode.

34. The method of claim 33, wherein the fuel inlet tube is in electrical contact with the liquid metal anode and conveys the electrical potential to the liquid metal anode, the material comprising the fuel inlet tube maintaining its electrical conductivity in a reducing environment.

35. The method of claim 34, wherein the material comprising the fuel inlet tube and physical dimensions of the fuel inlet tube maintain an electrical resistance between the liquid metal anode and a source of the electrical potential of below about 1 ohm.

36. The method of claim 34, comprising at least two fuel inlet tubes, wherein the material comprising the at least two fuel inlet tubes and physical dimensions of the fuel inlet tubes maintain an electrical resistance between the liquid metal anode and a source of the electrical potential of below about 1 ohm.

37. The method of claim 33, further comprising one or more current collectors in electrical contact with the liquid metal anode, the one or more current collectors conveying the electrical potential to the liquid metal anode, and the one or more current collectors comprising a material that maintains its electrical conductivity in a reducing environment.

38. The method of claim 37, wherein the material comprising the one or more current collectors and physical dimensions of the current collectors maintain an electrical resistance between the liquid metal anode and a source of the electrical potential of below about 1 ohm.

39. The method of claim 37, wherein the one or more current collectors comprise at least one of nickel, cobalt, iron, chromium, manganese, molybdenum, tungsten, niobium, iridium, titanium; alloys comprised of greater than about 60% by weight of nickel, cobalt, iron, chromium, manganese, molybdenum, tungsten, niobium, iridium, titanium, aluminum or silicon; materials coated with nickel, cobalt, iron, chromium, manganese, molybdenum, tungsten, niobium, iridium, titanium, and materials coated with alloys comprised of greater than about 60% by weight of nickel, cobalt, iron, chromium, manganese, molybdenum, tungsten, niobium, iridium, titanium, aluminum or silicon.

40. The method of claim 37, wherein the combination of the one or more current collectors and liquid metal anode comprises at least one of nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, and iridium-copper.

41. The method of claim 33, wherein the reducing environment has an oxygen partial pressure of less than about $10^{-4}$ atmospheres.

42. The method of claim 33, wherein oxidation of the anode or fuel inlet tube is prevented.

43. The method of claim 33, wherein deposition of carbon or sulfur in the inlet and exit is prevented.

44. The method of claim 33, wherein the fuel comprises at least about a 2:1 ratio of hydrogen to carbon atoms.

45. The method of claim 33, wherein the fuel comprises at least a 1:1 ratio of oxygen atoms to carbon atoms.

46. The method of claim 33, wherein sufficient fuel relative to oxygen is provided such that oxidation of the liquid anode or fuel inlet is prevented.

47. The method of claim 33, further comprising collecting the metallic species.

48. The method of claim 33, wherein the liquid metal anode is comprised of at least one of silver, copper, tin, bismuth, and alloys comprised of greater than about 60% by weight of silver, copper, tin, or bismuth.

49. The method of claim 33, wherein the fuel inlet tube comprises at least one of nickel, cobalt, iron, chromium, manganese, molybdenum, tungsten, niobium, iridium, titanium; alloys comprised of greater than about 60% by weight of nickel, cobalt, iron, chromium, manganese, molybdenum, tungsten, niobium, iridium, titanium, aluminum or silicon; materials coated with nickel, cobalt, iron, chromium, manganese, molybdenum, tungsten, niobium, iridium, titanium, and materials coated with alloys comprised of greater than about 60% by weight of nickel, cobalt, iron, chromium, manganese, molybdenum, tungsten, niobium, iridium, titanium, aluminum or silicon.

50. The method of claim 33, wherein the combination of the one or more current collectors and liquid metal anode comprises at least one of nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, and iridium-copper.

51. The method of claim 33, wherein the fuel comprises hydrogen and carbon.

52. The method of claim 33, wherein the fuel comprises at least one of syngas, natural gas, a mixture of natural gas and steam and a mixture of natural gas and carbon dioxide.

53. The method of claim 33, wherein at least a portion of an exhaust product produced during the production of the metal from the metal oxide is mixed with the gaseous fuel.

54. The method of claim 33, further comprising controlling the electrical potential to modulate oxygen production.

55. The method of claim 33, wherein coking is reduced or prevented.

56. The method of claim 33, wherein fuel inlet and/or current collector is protected from oxidation.

57. An apparatus for producing a metal from a metal oxide comprising:

(a) an electrolyte container for holding an electrolyte;

(b) a cathode disposed in the electrolyte container;

(c) a liquid metal anode container for holding a liquid metal anode and for maintaining the liquid metal anode separate from the cathode and the electrolyte, at least a portion of the liquid metal anode container comprising a solid oxygen ion conducting membrane;

(d) a fuel inlet tube having an outlet disposed in the liquid metal anode container, the fuel inlet tube comprising a material that maintains its structural integrity in a reducing environment; wherein the fuel inlet tube configuration is selected from at least one of a tube comprising holes, a tube comprising notches at a tube end in electrical contact with the liquid metal anode, and a tube comprising notched holes; and (e) a power supply for establishing a potential between the cathode and the anode.

58. The apparatus of claim 57, wherein the fuel inlet tube is in electrical contact with the liquid metal anode disposed in the liquid metal anode container and conveys the electrical potential to the liquid metal anode, the material comprising the fuel inlet tube maintaining its electrical conductivity in a reducing environment.

59. The apparatus of claim 58, wherein the material comprising the fuel inlet tube and physical dimensions of the fuel inlet tube maintain an electrical resistance between the liquid metal anode disposed in the liquid metal anode container and a source of the electrical potential of below about 1 ohm.

60. The apparatus of claim 58, comprising at least two fuel inlet tubes, wherein the material comprising the at least two fuel inlet tubes and physical dimensions of the fuel inlet tubes maintain an electrical resistance between the liquid metal anode disposed in the liquid metal anode container and a source of the electrical potential of below about 1 ohm.

61. The apparatus of claim 57, further comprising one or more current collectors disposed the liquid metal anode container and in electrical contact with the liquid metal anode disposed in the liquid metal anode container, the one or more current collectors conveying the electrical potential to the liquid metal anode, and the one or more current collectors comprising a material that maintains its electrical conductivity in a reducing environment.

62. The apparatus of claim 61, wherein the material comprising the one or more current collectors and physical dimensions of the current collectors maintain an electrical resistance between the liquid metal anode and a source of the electrical potential of below about 1 ohm.

63. The apparatus of claim 61, wherein the one or more current collectors comprise of at least one of nickel, cobalt, iron, chromium, manganese, molybdenum, tungsten, niobium, iridium, titanium; alloys comprised of greater than about 60% by weight of nickel, cobalt, iron, chromium, manganese, molybdenum, tungsten, niobium, iridium, titanium, aluminum or silicon; materials coated with nickel, cobalt, iron, chromium, manganese, molybdenum, tungsten, niobium, iridium, titanium, and materials coated with alloys comprised of greater than about 60% by weight of nickel, cobalt, iron, chromium, manganese, molybdenum, tungsten, niobium, iridium, titanium, aluminum or silicon.

64. The apparatus of claim 61, wherein the combination of the one or more current collectors and liquid metal anode comprises at least one of nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, and iridium-copper.

65. The apparatus of claim 57, wherein the material comprising the fuel inlet tube maintains its structural integrity in a reducing environment having an oxygen partial pressure of less than about $10^{-4}$ atmospheres.

66. The apparatus of claim 57, wherein the liquid metal anode is comprised of at least one of silver, copper, tin, bismuth, and alloys comprised of greater than about 60% by weight of silver, copper, tin, or bismuth.

67. The apparatus of claim 57, wherein the fuel inlet comprises of at least one of nickel, cobalt, iron, chromium, manganese, molybdenum, tungsten, niobium, iridium, titanium; alloys comprised of greater than about 60% by weight of nickel, cobalt, iron, chromium, manganese, molybdenum, tungsten, niobium, iridium, titanium, aluminum or silicon; materials coated with nickel, cobalt, iron, chromium, manganese, molybdenum, tungsten, niobium, iridium, titanium, and materials coated with alloys comprised of greater than about 60% by weight of nickel, cobalt, iron, chromium, manganese, molybdenum, tungsten, niobium, iridium, titanium, aluminum or silicon.

68. The apparatus of claim 57, wherein combination of the one or more current collectors and liquid metal anode comprises at least one of nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, and iridium-copper.

* * * * *